US007282315B2

(12) United States Patent
Ishihara et al.

(10) Patent No.: US 7,282,315 B2
(45) Date of Patent: Oct. 16, 2007

(54) DEVELOPER, DEVELOPER CARTRIDGE, AND IMAGE FORMING APPARATUS

(75) Inventors: Toru Ishihara, Tokyo (JP); Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/290,782

(22) Filed: Dec. 1, 2005

(65) Prior Publication Data

US 2006/0084004 A1 Apr. 20, 2006

Related U.S. Application Data

(62) Division of application No. 10/370,517, filed on Feb. 24, 2003.

(30) Foreign Application Priority Data

Mar. 29, 2002 (JP) ..... 2002-096715

(51) Int. Cl.
*G03G 5/00* (2006.01)

(52) U.S. Cl. ..... 430/137.2; 430/137.18; 399/252

(58) Field of Classification Search ..... 430/137.2, 430/137.18; 399/252
See application file for complete search history.

(56) References Cited

U.S. PATENT DOCUMENTS 5,863,692 A * 1/1999 Nakamura et al. ..... 430/108.4

* cited by examiner

*Primary Examiner*—Mark A. Chapman
(74) *Attorney, Agent, or Firm*—Takeuchi & Kubotera, LLP

(57) ABSTRACT

A method of producing a developer includes the steps of: kneading at least a resin and a colorant; reducing the kneaded resin and colorant to coarse powders; adding an additive agent to the coarse powders; reducing the coarse powders with the additive agent to fine powders; and classifying the fine powders to provide the developer.

9 Claims, 7 Drawing Sheets

| | Composition of mixture | Pre-addition treatment | Additive agent |
|---|---|---|---|
| Example 1 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Coarsely powdered (1 mm). | Silica:<br>R972 1 part<br>RX50 1 part |
| Example 2 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Powdered and classified by dispersion separator (8 μm) | Silica:<br>R972 1 part<br>RX50 1 part |
| Example 3 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Coarsely powdered (1 mm). | Silica:<br>R972 1.5 part<br>RX50 1.5 part |
| Example 4 | PER 100 parts<br>CPB 4.5 parts<br>CCA 2.5 parts<br>PEW 6.0 parts | Mixture agitated, kneaded by Henschel mixture.<br>Melted at 120°C, 3hours by roll mill, cooled to room temperature.<br>Coarsely powdered (1 mm). | Silica:<br>R972 1 part<br>RX50 1 part |
| Example 5 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Coarsely powdered (1 mm). | Silica:<br>R972 0.5 part<br>RX50 0.5 part |
| Example 6 | PER 100 parts<br>CPB 4.5 parts<br>CCA 2.5 parts<br>PEW 6.0 parts | Mixture agitated, kneaded by Henschel mixture.<br>Melted at 120°C, 3hours by roll mill, cooled to room temperature.<br>Coarsely powdered (1 mm). | Aluminum oxide: 1 part<br>T805 1 part |
| Example 7 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Coarsely powdered (1 mm). | Silica:<br>R972 0.1 part<br>RX50 0.1 part |
| Example 8 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Powdered and classified by dispersion separator (8 μm). | Silica:<br>R972 1 part<br>RX50 1 part |
| Example 9 | Polymerized toner:<br>ST 77.5 parts<br>AnB 22.5 parts<br>LMPE 1.5 parts<br>CCA 2 parts<br>CB 7 parts<br>AIBN 1 part | polymerization | Silica:<br>R972 1 part<br>RX50 1 part |

PER: polyester resin CPB: copper phthalocyanine blue CCA: charging controlling agent PEW: polyethylene wax ST: styrene AnB: acrylic-acid-n-butyl LMP: low molecular weight polyethylene CB: carbon black AIBN: 2,2'-azobis-isobutyl-nitrile

FIG. 3Aa

| | Post-addition treatment | Floating additive agent (mg) | Extrication amount | filming | Blurry print | Integrated evaluation |
|---|---|---|---|---|---|---|
| Example 1 | Finely powdered and classified by dispersion separator (8 μm) | 8.1 | $2.7 \times 10^{-5}$ | none | none | ○ |
| Example 2 | Agitated at 3,000 r/min, 120 sec. by Henschel mixer. Re-classified at 8 μm by dispersion separator. | 6.5 | $2.2 \times 10^{-5}$ | none | none | ○ |
| Example 3 | Finely powdered and classified by dispersion separator (8 μm) | 12 | $4.0 \times 10^{-5}$ | none | none | ○ |
| Example 4 | Finely powdered and classified by dispersion separator (8 μm) | 7.5 | $2.5 \times 10^{-5}$ | none | none | ○ |
| Example 5 | Finely powdered and classified by dispersion separator (8 μm) | 2.9 | $9.7 \times 10^{-6}$ | none | none | ○ |
| Example 6 | Finely powdered and classified by dispersion separator (8 μm) | 7 | $2.3 \times 10^{-5}$ | none | none | ○ |
| Example 7 | Finely powdered and classified by dispersion separator (8 μm) | 0.75 | $0.75 \times 10^{-6}$ | none | Slightly occurred | △ |
| Example 8 | Agitated at 3,000 r/min, 120 sec by Henschel mixer. | 15.5 | $5.2 \times 10^{-5}$ | none | none | △ |
| Example 9 | Agitated at 3,000 r/min, 120 sec. by Henschel mixer. Re-classified at 8 μm by dispersion separator. | 8 | $2.7 \times 10^{-5}$ | Slightly occurred | none | ○ |

FIG. 3Ab

| | Composition of mixture | Pre-addition treatment | Additive agent |
|---|---|---|---|
| Comparative example 1 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Powdered and classified by dispersion separator (8 μm). | Silica:<br>R972 1 part<br>RX50 1 part |
| Comparative example 2 | PER 100 parts<br>CPB 4.5 parts<br>CCA 2.5 parts<br>PEW 6.0 | Mixture agitated, kneaded by Henschel mixture.<br>Melted at 120°C, 3hours by roll mill, cooled to room temperature.<br>Powdered and classified by dispersion separator (8 μm). | Aluminum oxide: 1 part<br>T805 1 part |
| Comparative example 3 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Powdered and classified by dispersion separator (8 μm). | Silica:<br>R972 0.5 part<br>RX50 0.5 part |
| Comparative example 4 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Powdered and classified by dispersion separator (8 μm). | Silica:<br>R972 0.4 part<br>RX50 0.4 part |
| Comparative example 5 | PER 100 parts<br>CPB 4.5 parts<br>CCA 2.5 parts | Mixture agitated, kneaded by Henschel mixture.<br>Melted at 120°C, 3hours by roll mill, cooled to room temperature.<br>Powdered and classified by dispersion separator (8 μm). | Silica:<br>R972 0.1 part |
| Comparative example 6 | Polymerized toner:<br>ST 77.5 parts<br>AnB 22.5 parts<br>LMPE 1.5 parts<br>CCA 2 parts<br>CB 7 parts<br>AIBN 1 part | polymerization | Silica:<br>R972 1 part<br>RX50 1 part |

PER: polyester resin CPB: copper phthalocyanine blue CCA: charging controlling agent PEW: polyethylene wax ST: styrene AnB: acrylic-acid-n-butyl LMP: low molecular weight polyethylene CB: carbon black AIBN: 2,2' –azobis-isobutyl-nitrile

FIG. 3Ba

| | Post-addition treatment | Floating additive agent (mg) | Extrication amount | filming | Blurry print | Integrated evaluation |
|---|---|---|---|---|---|---|
| Comparative example 1 | Agitated at 3,000 r/min, 120 sec. by Henschel mixer. | 40.5 | $1.4 \times 10^{-4}$ | occurred | occurred | X |
| Comparative example 2 | Finely powdered and classified by dispersion separator (8 $\mu$m) | 35.6 | $1.2 \times 10^{-4}$ | occurred | occurred | X |
| Comparative example 3 | Agitated at 3,000 r/min, 120 sec. by Henschel mixer. | 20.5 | $6.8 \times 10^{-5}$ | occurred | occurred | X |
| Comparative example 4 | Agitated at 3,000 r/min, 120 sec. by Henschel mixer. | 17 | $5.7 \times 10^{-5}$ | occurred | occurred | X |
| Comparative example 5 | Agitated at 3,000 r/min, 120 sec. by Henschel mixer. | 2 | $6.7 \times 10^{-6}$ | none | Remarkably occurred | X |
| Comparative example 6 | Agitated at 3,000 r/min, 120 sec. by Henschel mixer. | 40.1 | $1.3 \times 10^{-4}$ | occurred | occurred | X |

FIG. 3Bb

DEVELOPER, DEVELOPER CARTRIDGE, AND IMAGE FORMING APPARATUS

CROSS-REFERENCE TO RELATED APPLICATIONS

This is a divisional application of the prior application Ser. No. 10/370,517 filed Feb. 24, 2003, pending.

BACKGROUND OF THE INVENTION

1. Field of the Invention

The present invention relates to a developer, a developer cartridge, and an image forming apparatus.

2. Description of the Related Art

An image forming apparatus by electrophotography comprises a photosensitive body, a charging device, an exposing device, a developing device, a transferring device, and a fixing device.

In the image forming apparatus, the surface of an image drum (a photosensitive drum) of the photosensitive body is equally, uniformly charged by a charging roller, and then, exposed by an LED head so that an electrostatic latent image is formed. In the developing process, a developer or toner, is adhered to the electrostatic latent image by the developing device to form a toner image. The toner image is transferred onto a print medium or paper by a transferring roller. The print paper carrying the toner image is fed to the fixing device so that the toner image is fused (fixed) on the paper. The developing device comprises a pair of fusing rollers to press the heated and melted toner of the toner image.

In order to provide a satisfactory fusion in the fixing device, it is necessary that the toner be easy to be melted. Also, a parting agent is added to the toner to easily part the toner from the fusing roller. Many of the parting agents have the property of being melted more easily than the resin contained in the toner.

Thus, it is possible to make the toner to be melted more easily by using this property, thereby increasing the fusing characteristic. Also, it is possible to prevent a hot offset phenomenon that the melted toner in the fixing device is adhered to the fusing roller. That is, the parting agent secures an offset margin.

A synthetic wax, such as polyethylene or polypropylene, or a natural wax, such as carnauba, is added alone or in combination to the resin, a main component of the toner. It is well known that a softener, such as a fatty acid ester, has a similar parting property and is used as the parting agent.

When an OHP sheet is used, the image forming apparatus of a color electrophotographic system, such as a color printer or a color copying machine requires a high OHP transparency in contrast to the image forming apparatus of a monochrome system. Consequently, the toner is required to be melted more readily than before.

A fluidizing agent (hereinafter "additive agents") is usually added to toner particles containing crystal resin (hereinafter "developer primary particle") to reduce the viscosity and increase the fluidization of the toner. Examples of the additive agent includes an inorganic abradant, such as a silicon oxide (silica), a surface-treated silica, titanium, a titanium oxide, a surface-treated titanium oxide, a clay, alumina, and calcium carbonate, and an organic abradant, such as a methacrylic resin abradant, a melanin resin abradant, and silicone resin abradant.

The particle diameter of the additive agent is smaller that that of the developer primary particle, that is, 2–5,000 nm, generally 5–2,000 nm.

In the manufacturing process of the toner, an adding apparatus, such as a Henschel mixer, is used for adhering the additive agent to the surfaces of the developer primary particles to make the finished toner.

In the conventional image forming apparatus, however, printing endurance tests show that a developing blade filming and/or an image drum filming occurred due to the adhesion of the toner and/or additive agent to the surfaces of a developing blade and/or an image drum, when the used toner has a viscosity coefficient of $1\times10^4$ (poise) at 105° C. measured by a flow tester and one part by weight of R972 (made by Nippon Aerosil Co., Ltd.) and one part by weight of RX50 (made by Nippon Aerosil Co., Ltd.) as the additive agent).

This developing blade filming occurred in printing a few hundreds of sheets in contrast to the usual blade filming that occurs in printing as many as a few thousands to a few tens of thousands of sheets. Especially in the color printing, photo-pictures and/or poster pictures of a high printing duty are continuously printed so that the developing blade filming occurs more frequently. In addition, when a toner having a low viscosity coefficient is used, the developing blade filming occurs even for a document having a low printing duty.

The probability of the image drum filming is slightly lower than that of the developing blade filming. However, when a toner having a low viscosity coefficient when melted and photo-pictures and/or poster pictures are continuously printed, the image drum filming occurs.

SUMMARY OF THE INVENTION

Accordingly, it is an object of the invention to provide a developer, a developer cartridge, and an image forming apparatus, which can control the filmings.

An developer according to the invention comprises developer primary particles including at least a resin and a colorant, and an additive agent that has a particle diameter smaller than that of the developer primary particles, wherein the extrication amount of the additive agent is less than $5.2\times10^{-5}$ part by weight with respect to the developer primary particles. By doing above, the filmings are prevented.

DESCRIPTION OF THE PREFERRED EMBODIMENTS

Embodiments of the invention will now be described with reference to the accompanying drawings.

Figure 1:
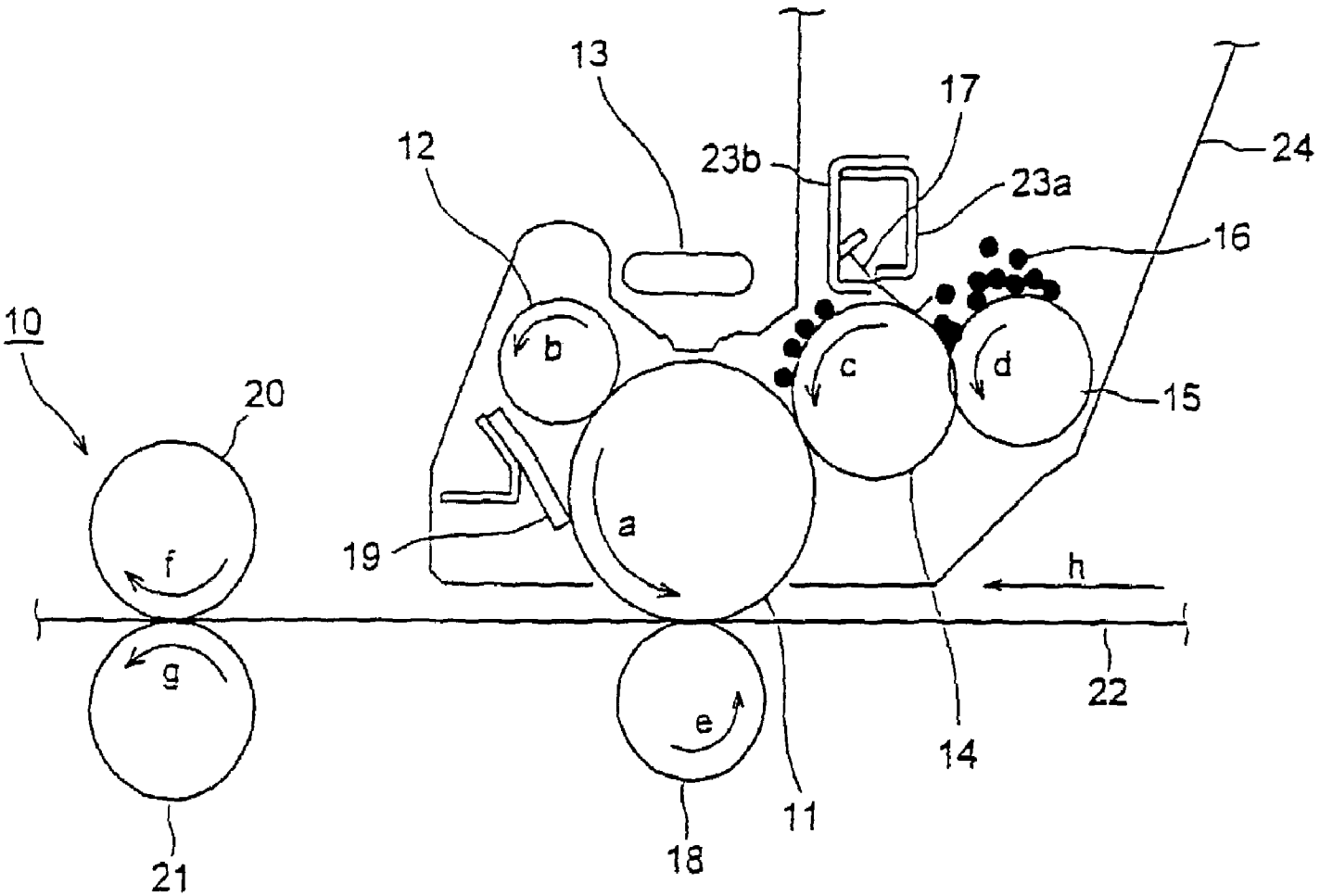
FIG. 1 is a schematic view of an image forming apparatus of electrophotography according to an embodiment of the present invention.
Figure 2:
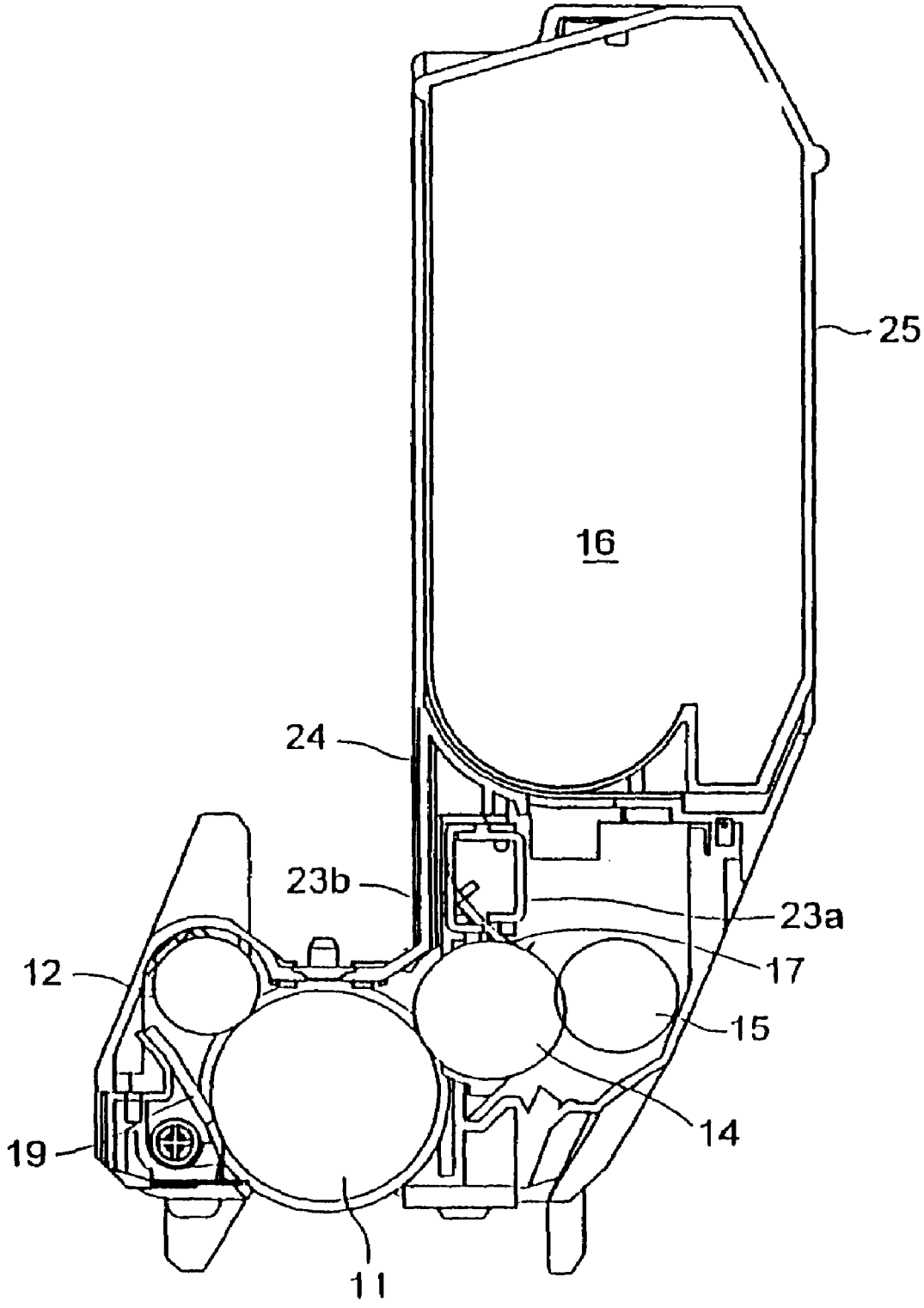
FIG. 2 is a sectional view of a developer cartridge according to the embodiment of the present invention.

In FIG. 1, an image holding device or image drum 11 is rotated in a direction of an arrow "a", and a charging device or charging roller 12 is brought into contact with the image drum 11 for rotation in a direction of arrow "b" and received a voltage from a power supply (not shown) for charging the image drum 11. A charging apparatus of non-contact system, such as scorotoron or corotoron, may be used instead of the charging roller.

An LED head 13 is an exposing device that forms an electrostatic latent image on the image drum 11 that has been charged by the charging roller 12. A LASER may be used instead of the LED head 13. A developer holding device or developing roller 14 is disposed in or out of contact with the image drum 11 and rotated in a direction of an arrow "c". The developing roller 14 carries a toner 16 to a development area, adheres the toner 16 to the electrostatic latent image, and makes the electrostatic latent image visible to form a toner image. A toner supplying roller 15 is disposed in or out of contact with the developing roller 14, rotated in a direction of an arrow "d" to supply the toner 16 to the developing roller 14. A developer controlling member or developing blade 17 makes a thin layer of the supplied toner 16. The developing roller 14 and toner supplying roller 15, and developing blade 17 constitute a developing device.

A transferring device or transferring roller 18 is disposed in contact with the image drum 11, rotated in a direction of an arrow "e", and receives a voltage from a power supply (not shown). The transferring roller 18 transfers the visible toner image formed on the image drum 11 to a medium or paper sheet 22, such as a paper or OHP sheet, which is fed in the direction of an arrow "h". A transferring device of non-contact corotoron type may be used instead of the transferring roller 18. A cleaning device 19 cleans the toner 16 remaining on the image drum 11 after the toner image is transferred onto the paper sheet 22. For the cleaning device in this embodiment, a blade cleaning device is used, wherein a rubber blade is brought into contact with the image drum 11. Instead of the rubber blade type, a roller type, wherein a roller is brought into contact with the image drum 11 for rotation, and a brush type may be used for the cleaning device.

A fusing device 10 for fusing the transferred toner image on the paper 22 comprises a heating roller 20 and a pressing roller 21. The heating roller 20 is rotated in a direction of an arrow "f". The surface of the heating roller 20 is heated by a power supply (not shown) to melt the transferred toner image 16 on the paper 22. The pressing roller 21 is rotated in a direction of an arrow "g" and presses the melted toner 16 on the paper 22. In the embodiment, the fusing device 10 of the roller type is described; however, a belt type, a film type, or a flash type using luminous energy may be used. In the roller type or belt type fusing device, an oil supply fusing system is employed, which comprises an oil supply devices, such as an oil supply roller, an oil supply sheet, and an oil tank, to supply oil to the heating roller 20 and the belt to positively prevent occurrence of the hot off-set phenomenon. The type of oil is not critical, but oil having a relatively low viscosity coefficient, such as silicone oil or mineral oil, is generally used. Also, an oil-less fusing system, which require no oil supply, may be used to prevent occurrence of the hot off-set phenomenon.

Reference number 23*a* denotes a blade stopper, 23*b* a blade holder, 24 an ID unit, and 25 a developer cartridge, or toner cartridge for containing the toner 16. As result of observations and analyses including an observation by an electron microscopic picture (hereinafter "SEM observation"), an element analysis, and an infrared absorption analysis (hereinafter "IR analysis) to understand the cause of the developing blade filming and image drum filming, it was found that the mechanism of both the fillings are the same. The additive agent is adhered to the surface of the developing blade 17 or the surface of the image drum 11, then, the developer primary particles are adhered on it. This is supported by the following facts:

1. The adhesion of a large amount of silica was observed by the SEM observation.

2. The element analysis and the IR analysis revealed that the ratio of the peak strength of silicon, which shows the presence of silica, to the peak strength of carbon, which shows the presence of the developer primary particles, was a few tens times larger than that obtained from the toner that was used in the test.

3. Although a relatively large amount of the developer primary particles was observed on the outermost surface, as the surface of the developer primary particles are striped, only silica was observed in the region closest to the surfaces of the developing blade 17 and image drum 11.

Also, where a toner containing the developer primary particles but no additive agent is used for the comparison test, no filming was observed after 30,000 sheets were printed. In a similar test using a toner having a viscosity coefficient of $1\times10^6$ (poise) at 105° C., although the filming was observed, the number of the printed sheets before the filming was a few times higher than that of the toner with the additive agent. Also, the SEM observation revealed that the toner in the outermost layer was more uneven than the toner having a viscosity coefficient of $1\times10^4$ (poise).

Thus, when a toner has no additive agent and a high viscosity (a low fluidization), the filming is relatively rare or the number of sheets printed before the filming is large. Namely, it was found that the additive agent is adhered or fixed on the surface of the developing blade 17 or the image drum 11, forming a grounding that is prone to the filming, then, the developer primary particles are caught by the grounding and melted by the friction heat, thereby to form the filming. Also, the fact that the frequency of the filming varies with the printing duty is explained as follows.

A certain amount of the additive agent is floating in the toner including the additive agent (hereinafter "floating additive agent"). In the print of high printing duty, a large amount of toner passes through the developing blade 17. In proportion of the amount of toner passing through the developing blade 17, a large amount of the floating additive agent passes through the developing blade 17, thus causing more developing blade filming. By contrast, in the print of low printing duty, a certain amount of the toner on the developing roller 14 remains in the vicinity of the developing roller 14 and is subject to the frequent frictions with the toner supplying roller 15, developing roller 14, and developing blade 17 so that the floating additive agent is firmly adhered to the developer primary particles, thereby to control occurrence of the developing blade filming.

This is applicable to the image drum filming. In the print of high printing duty, the amount of the remaining toner is larger that that in the print of low printing duty. Accordingly, the amount of the remaining toner passing through the cleaning device 19 is so large that a part of the additive agent is not cleaned due to its small particle diameter with respect to that of the developer primary particles and fixed to the surface of the image drum 11. The toner particles are caught by the additive agent on the image drum and melted, causing the image drum filming. The above explanation is justified by the fact that when the cleaning device 19 is removed, the image drum filming does not occur.

In the manufacturing process of the toner 16, when the additive agent is added at the final process, it is adhered to the surfaces of the developer primary particles by high energy generated by an adding device, such as a Henschel mixer. However, a part of the additive agent always stays alone without being adhered. A simple measurement confirmed that the amount of the staying or floating additive agent is approximately 0.5–1.0% of additive agent added.

For example, if 1% of the additive agent with respect to the developer primary particles is added and 0.5% of the additive agent stays alone, only $1\times10^{-5}$ part by weight of the additive agent stays alone. This is very small amount. However, the most frequently used additive agent is very small and has a size of only approximately 6–40 nm, while the developer primary particles have a size of a few μm. Consequently, the amount of staying additive agent cannot be ignored if viewed from the number of particles. Accordingly, even if a small part of the staying additive agent is adhered and fixed to the developing blade 17 and the image drum 11, it causes the filming.

In the embodiment, the following methods were carried out to prevent the filming by removing the floating additive agent.

In the first method, the additive agent is added before the process of determining the particle diameter of the toner. There are two steps to provide pounded toner; the first step is reducing the toner to coarse powder and the second step is reducing the toner to fine powder. The particle diameter of the toner is determined at the second step. In the first method, the additive agent is added after the first step but prior to the second step.

The additive agent is firmly adhered to the surfaces of the developer primary particles by energy applied at the second step. Even if there is the floating agent after the second powdering step, it is removed at the classifying step following the second powdering step because the particle diameter of the additive agent is much smaller than that of the finished toner. The amount of the floating additive agent in the toner according to this method is $1\times10^{-6}$ part by weight, which is a few times smaller than the amount of the floating additive agent in the toner according to the ordinary method. When performing the printing endurance test by using this toner, neither developing blade filming nor image drum filming occurred after printing 50,000 sheets, which is excellent result.

In the second method, the step of reducing to fine powder is performed in the ordinary way and the additive agent having a particle diameter smaller than that of the finished toner particle is removed at the classifying step following the finely powdering step. In this case, the amount of the floating additive agent was $1\times10^{-6}$ part by weight, which is one tenth of that of the toner according to the ordinary method. When performing the printing endurance test by using this toner, neither developing blade filming nor image drum filming occurred after printing 50,000 sheets, which is excellent result.

Examples of toner according to the present invention and comparisons will now be described.

Figure 3:
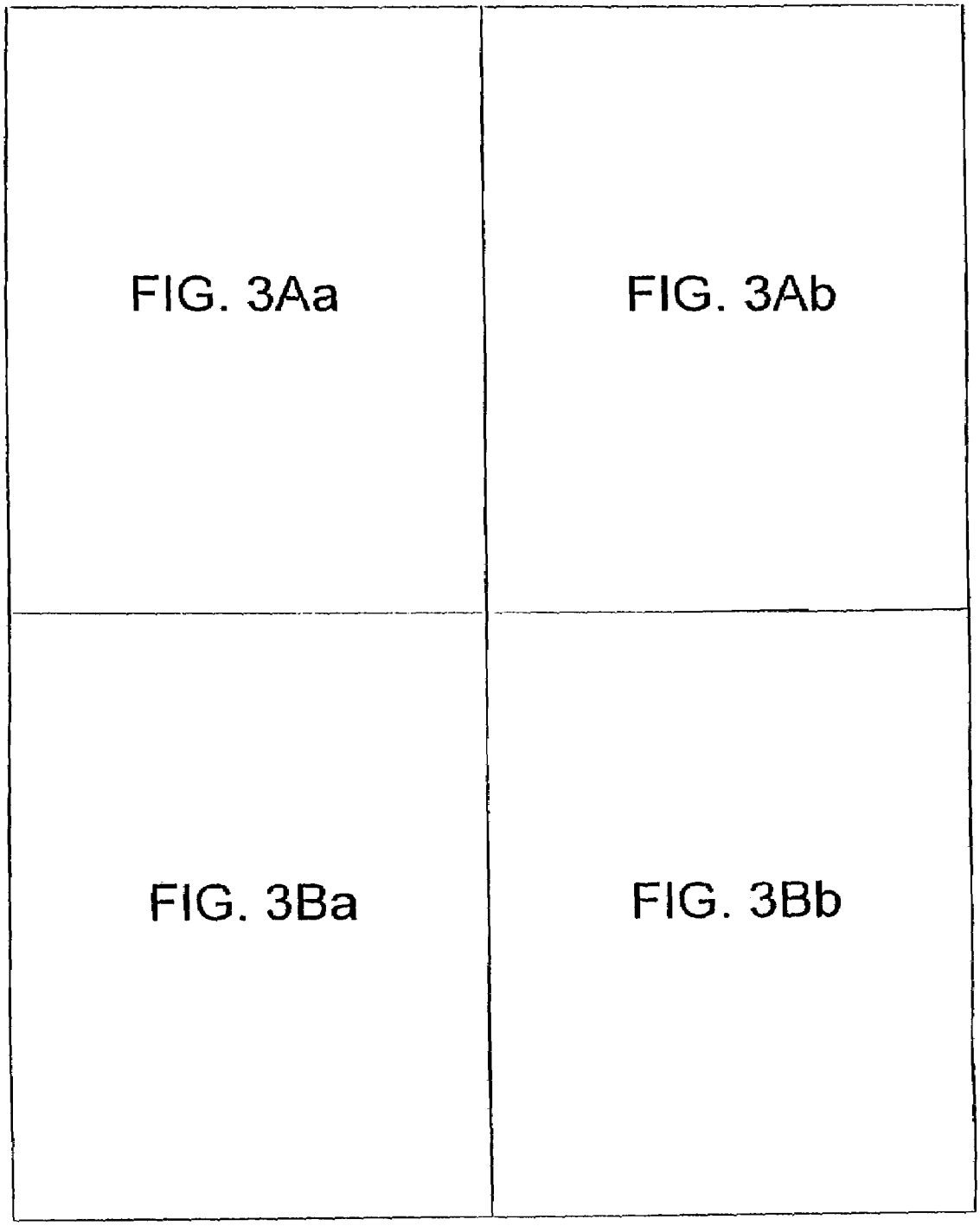
FIG. 3 is a summary of examples according to the embodiment of the present invention and comparative examples.

In FIG. 3, compositions of mixture, content of pretreatment before adding the additive agent, compositions of the additive agent, post-treatment after adding the additive agent, amount of the floating additive agent per 300 g of toner, amount of the additive agent extricated from the developer primary particles, occurrence of the filming, occurrence of blurry print, and integrated evaluation are shown. All parts are parts by weight. In the integrated evaluation, ○ represents excellent, Δ represents good, and X represents poor. The extricated amount of the additive agent is the proportion of the floating additive agent to 300 g of the toner and is expressed by parts by weight of the floating additive agent with respect to the developer primary particles.

In each example, more than 0.2 part by weight of the additive agent is added to the developer primary particles.

EXAMPLE 1

A mixture composed of 100 parts by weight of polyester resin (the average number of molecular weight Mn=3,700, glass transition point Tg=62° C.), 4.5 parts by weight of copper futhalocyanine blue as a colorant, 2.5 parts by weight of charging controlling agent is fully agitated and kneaded by Henschel mixer, melted by heating at 120° C. for 3 hours by a roll mill, cooled to the room temperature, and reduced to coarse powders. Thus, chips having a particle diameter of approximately 1 mm were obtained as the material of the developer primary particles.

A silica of one part by weight of R972 (made by Nippon Aerosil Co., Ltd.) and 1 part by weight of RX50 (made by Nippon Aerosil Co., Ltd.) was added to the chips. The silica has a particle diameter smaller than that of the chips.

The silica-added chips were reduced to fine powders and classified by a dispersion separator (made by Nippon Pneumatic Mfg. Co., Ltd.) to provide the toner having an average particle diameter of 8 μm. Then, 300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate, was identified as the silica which was added as the additive agent. Also, as a result of the SEM observation, the silica alone formed the agglomerate, forming the floating additive agent. The amount of the floating additive agent at this time was 8.1 mg and the extrication amount was $2.7\times10^{-5}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there are provided satisfactory print density, no fog or gaps, such as white banding in a printing direction that is caused by the developing blade filming.

Also, the inspection revealed that the film of the image drum 11 wore by approximately 4 μm. However, no filming was observed.

EXAMPLE 2

A mixture composed of 100 parts by weight of polyester resin (the average number of molecular weight Mn=3,700, glass transition point Tg=62° C.), 4.5 parts by weight of copper futhalocyanine blue as a colorant, 2.5 parts by weight of charging controlling agent was fully agitated and kneaded by Henschel mixer, melted by heating at 120° C. for 3 hours by a roll mill, cooled to the room temperature. Then, the kneaded material was reduced to powders and classified by the dispersion separator to obtain chips having an average particle diameter of approximately 0.8 μm for the material of the developer primary particles.

A silica of one part by weight of R972 and one part by weight of RX50 was added to the chips. The silica has a particle diameter smaller than that of the chips.

The silica-added chips were agitated at 3,000 r/min. for 120 second by the Henschel mixer. Then, the silica was classified again by the dispersion separator, keeping the condition of the average particle diameter of 8 μm to provide the toner according to the embodiment.

Then, 300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 6.5 mg and the extrication amount was $2.2\times10^{-5}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there were provided satisfactory print density, no fog or gaps, such as white banding in a printing direction that is caused by the developing blade filming. Also, no image drum filming was observed.

EXAMPLE 3

The finished toner was obtained in the same way as that in the Example 1 except that the added silica was composed of 1.5 parts by weight of R972 and 1.5s part by weight of RX 50.

300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 12.0 mg and the extrication amount was $4.0\times10^{-5}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there were provided satisfactory print density, no fog or gaps, such as white banding in a printing direction that is caused by the developing blade filming. Also, no image drum filming was observed.

EXAMPLE 4

A mixture composed of 100 parts by weight of polyester resin (the average number of molecular weight Mn=3,700, glass transition point Tg=62° C.), 4.5 parts by weight of copper futhalocyanine blue as a colorant, 2.5 parts by weight of charging controlling agent, and 6.0 parts by weight of polyethylene wax "SP-105" (made by Sazol) was fully agitated and kneaded by the Henschel mixer, melted by heating at 120° C. for 3 hours by the roll mill, cooled to the room temperature. Then, the kneaded material was reduced to coarse powders to provide chips having a particle diameter of 1 mm for the material of the developer primary particles. A silica of one part by weight of R972 and one part by weight of RX50 was added to the chips. The silica has a particle diameter smaller than that of the chip.

The silica-added chips were reduced to fine powders and classified by the dispersion separator to provide the toner having an average particle diameter of 8 μm. Then, 300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 7.5 mg and the extrication amount was $2.5\times10^{-5}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there were provided satisfactory print density, no fog or gaps, such as white banding in a printing direction that is caused by the developing blade filming. Also, no image drum filming was observed.

EXAMPLE 5

The finished toner was obtained in the same way as that in the Example 4 except that the added silica was composed of 0.5 part by weight of R972 and 0.5 part by weight of RX 50.

300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 2.9 mg and the extrication amount was $9.7\times10^{-6}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there were provided satisfactory print density, no fog or gaps, such as white banding in a printing direction that is caused by the developing blade filming. Also, no image drum filming was observed.

EXAMPLE 6

The finished toner was provided in the same way as that in the Example 4 except that the added silica was composed of, instead of R972 and RX50, 1.0 part by weight of aluminum oxide C (made by NIPPON AEROSIL CO., LTD., CAS# 1344-28-1) and 1.0 part by weight of T805 (made by NIPPON AEROSIL CO., LTD.).

300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 7.0 mg and the extrication amount was $2.3\times10^{-5}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there were provided satisfactory print density, no fog or gaps, such as white banding in a printing direction that is caused by the developing blade filming. Also, no image drum filming was observed.

EXAMPLE 7

The finished toner was provided in the same way as that in the Example 1 except that the added silica was composed of 0.1 part by weight of R972 and 0.1 part by weight of RX 50.

300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 0.75 mg and the extrication amount was $0.75\times10^{-6}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there were provided satisfactory print density, no fog or gaps, such as white banding in a printing direction that is caused by the developing blade filming. Also, any image drum filming, wherein the toner and/or the floating additive agent is fixed to the surface of the image drum 11, did not appear. Slightly uneven print density, or blurry print was observed. The degree of the uneven print density or blurry print was substantially the same at the beginning and the end of the continuous printing test.

EXAMPLE 8

The finished toner was obtained in the same way as that of the Example 1 except that the added silica was composed of 0.3 part by weight of R972 and 0.3 part by weight of RX 50.

300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 15.5 mg and the extrication amount was $5.2\times10^{-5}$.

The printing endurance test that A-4 size sheets having full-image (printing duty is 100%) were continuously printed using this toner and the image forming apparatus in FIG. 1, was performed.

The test showed that after approximately 40,000 of sheets 22 were continuously printed, white banding in the printing direction and fog slightly appeared and after 50,000 sheets were printed, the degree of the white banding and fog were substantially the same as those of 40,000 sheets.

Also, a close observation revealed that a printing jump that is approx. 0.1 mm wide and approx. 1 mm long.

The SEM observation of the developing blade 17 revealed that the toner is fused to the contact area between the developing blade 17 and the developing roller 14. The SEM observation after careful removal of the fused toner revealed an agglomerate that is formed of the silica alone. Also, as a result of the element analysis, the peak of the silicon was much greater than that of the carbon, indicating that silica alone was adhered to the developing blade 17.

The inspection of the image drum 11 revealed that a great numbers of white materials having a width of approx. 0.1 mm wide and a length of approx. 1 mm in the rotation direction of the image drum are fixed to the image drum 11. The inspection to the surface of the image drum by a surface roughness tester revealed that the adhered material forms a projection that is approx. 0.05 mm high.

The SEM observation to the surface of the image drum 11 revealed that the toner is fused thereto. As a result of the IR analysis, the proportion of the peak of the CH expansion absorption, which indicates the presence of the developer primary particles, to the SiO deviation absorption, which indicates the presence of the silica, was substantially the same as that of the toner prepared according to this example.

Then, the SEM observation made after removal of the fused toner revealed that the silica alone was fixed to the surface of the image drum 11. That is, the IR chart of the material under the fused toner is very similar to the IR chart of the silica alone and, therefore, it is evident that the silica alone is adhered or fixed to the surface of the image drum and, then, the tone is fused on it.

From the above observation, it is ascertained that the developing blade filming and the image drum filming occur by the same mechanism. Also, it is ascertained that floating silica, which is not adhered to the toner, causes the filmings.

EXAMPLE 9

A mixture composed of 77.5 parts by weight of styrene, 22.5 parts by weight of acrylic-acid-n-butyl, 1.5 parts by weight of low molecular weight polyethylene as an offset preventing agent, 2 parts by weight of charging controlling agent "isen spiron black TRH" (made be Hodogaya Chemical Company), 7 parts by weight of carbon black (Printex L made by Degussa Huls) as a colorant, one part by weight of 2,2'-azobis-isobutyl-nitrile was input to atritor ("MA-01SC" made by Mitsui Miike Kakoki) and deflocculated at 15° C. for 10 hours to provide a polymer.

Also, 600 parts by weight of distilled water was added to 180 parts by weight of Ethanol, to which 8 parts by weight of polyacrylic acid and 0.35 part by weight of divinylbenzene are pre-dissolved, to provide a dispersion medium for polymerization. The above polymer was added to the dispersion medium and dispersed at 15° C., 8,000 rotations, for 10 minutes by TK homo-mixer ("M type" made by Tokushukikakogyo Co., Ltd.).

Then, 1 liter of the dispersed solution was agitated in a separable flask under nitrogen flow of 100 (rpm) to be reacted at 85° C. for 12 hours. A dispersionoid obtained at this first stage is called an intermediate particle.

An aquatic emulsion A composed of 9.25 parts by weight of methyl methacrylate, 0.75 part by weight of acrylic-acid-n-butyl, 0.5 part by weight of 2,2'-azobis-isobutyl-nitrile, 0.1 part by weight of lauric sulfuric acid sodium, and 80 parts of water, was prepared in an aquatic suspension of the intermediate particles by ultrasonic generator (US-150 made by Nippon Seiki Seisakusho Co., Ltd.). 9 parts by weight of the aquatic emulsion A were dropped into the intermediate particles to swell the intermediate particles. Although the observation by an optical microscope was made immediately after the drop of the aquatic emulsion, no aquatic emulsion was seen and, therefore, it was understood that the swelling of the intermediate particles had been completed in a very short time.

Then, the intermediate dispersionoid was further agitated under nitride for the reaction of the second stage polymerization at 85° C. for 10 hours. The dispersionoid was cooled and the dispersion medium was dissolved by aquatic hydrochloric acid of 0.5 N. The cooled dispersionoid was filtered, cleaned by water, dried by wind, and decompressed-dried at 10 mm Hg, 40° C. for 10 hours to provide the developer primary particles. Then, a silica composed of one part by weight of R972 and one part by weight of RX50 was added to thus provided developer primary particles.

The silica-added chips for the developer primary particles were agitated at 3,000 r/min for 120 seconds by the Henschel mixer, and reduced to powders and classified by the dispersion separator to provide a polymerized toner having an average particle diameter of 8 μm. The amount of the floating additive agent at this time was 8.0 mg and the extrication amount was $2.7\times10^{-5}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, the printing quality was not changed from the initial state. That is, there were provided satisfactory print density, no fog or gaps, such as white vertical banding that is caused by the developing blade filming. Also, no image drum filming was observed.

COMPARABLE EXAMPLE 1

A mixture composed of 100 parts by weight of polyester resin (the average number of molecular weight Mn=3,700, glass transition point Tg=62° C.), 4.5 parts by weight of copper futhalocyanine blue as a colorant, 2.5 parts by weight of charging controlling agent is fully agitated and kneaded by Henschel mixer, melted by heating at 120° C. for 3 hours by a roll mill, cooled to the room temperature, and reduced to powders and classified by the dispersion separator to obtain chips having an average particle diameter of approximately 0.8 μm as a material for the developer primary particles.

A silica composed of one part by weight of R972 and one part by weight of RX50 was added to the chips. The silica has a particle diameter smaller than that of the chips.

The silica-added chips were agitated at 3,000 r/min for 120 seconds by Henschel mixer to provide a pounded toner according to this comparative example.

Then, 300 g of the toner was screened by a screen having a mesh of 45 μm. After residue on the screen was cleaned by ethanol and the toner particles were removed, a large amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 40.5 mg and the extrication amount was $1.4\times10^{-4}$.

The printing endurance test that A-4 size sheets having full-image (printing duty is 100%) were continuously printed using this toner and the image forming apparatus in FIG. 1, was performed.

The test showed that after 1,000 of sheets 22 were continuously printed, white banding appeared in the printing direction, and fog also appeared proportionally. Since the white banding was increased as the number of printed copies was increased, the endurance test was stopped when 2,000 copies were finished.

Also, a great number of printing jumps (gaps) having a width of approx. 0.1 mm and a length of approx. 1 mm appeared.

The SEM observation of the developing blade 17 revealed that the toner is fused to the contact area between the developing blade 17 and the developing roller 14. The SEM observation after careful removal of the fused toner revealed that agglomerate is formed of the silica alone. As a result of the element analysis, the peak of the silicon was much stronger than that of the carbon, indicating that silica alone is adhered to the developing blade 17.

The inspection of the image drum 11 revealed that a great number of white adhering materials having a width of approx. 0.1 mm and a length of approx. 1 mm are fixed to the image drum 11 in the rotation direction of the image drum. The inspection of the surface of the image drum by a surface roughness tester revealed that the adhering material forms a projection that has a height of approx. 0.05 mm.

The SEM observation of the surface of the image drum 11 revealed that the toner is fused thereto. As a result of the IR analysis, the proportion of the peak of the CH expansion absorption, which shows the presence of the developer primary particles, to the SiO deviation absorption, which shows the presence of the silica, was substantially the same as those of the toner according to this comparable example.

Then, the SEM observation made after careful removal of the fused toner revealed that the silica alone was fixed to the surface of the image drum 11. That is, the IR chart of the material under the fused toner is very similar to the IR chart of the silica alone and, therefore, it is evident that the silica alone adhered or was fixed to the surface of the image drum 11 and, then, the toner was fused on it.

From the above observation, it is ascertained that the developing blade filming and the image drum filming occurred, and the floating silica, which did not adhere to the toner, caused the fillings.

COMPARABLE EXAMPLE 2

A toner according to this comparable example is manufactured in the same way as that of the comparable example 1 except that one part by weight of aluminum oxide C and one part by weight of T805 were used instead of R972 and RX50 as the additive agent.

Then, 300 g of the toner was screened by a screen having a mesh of 45 μm. After residue on the screen was cleaned by ethanol and the toner particles were removed, a large amount of white agglomerate was observed by visual observation. As a result of the IR analysis, the agglomerate was identified as the titanium oxide which was added as the additive agent. Also, as a result of the SEM observation, the titanium oxide alone formed the agglomerate, forming the floating additive agent. The amount of the floating additive agent at this time was 35.6 mg and the extrication amount was $1.2\times10^{-4}$.

The printing endurance test that A-4 size sheets having full-image (printing duty is 100%) were continuously printed using this toner and the image forming apparatus in FIG. 1, was performed.

The test showed that after 500 of sheets 22 were continuously printed, white banding appeared in the direction of printing, and fog also appeared proportionally. Since the white banding was increased as the number of printed copies was increased, the endurance test was stopped when 2,000 copies were finished.

Also, a great number of printing jumps (gaps) having a width of approx. 0.1 mm and a length of approx. 1 mm appeared.

he SEM observation of the developing blade 17 revealed that the toner was fused to the contact area between the developing blade 17 and the developing roller 14. The SEM observation after careful removal of the fused toner revealed that agglomerate is formed of the titanium oxide alone. As a result of the element analysis, the peak of the titanium was much stronger than that of the carbon, which shows that titanium oxide alone was adhered to the developing blade 17.

he inspection of the image drum 11 revealed that a great number of white adhering materials having a width of approx. 0.1 mm and a length of approx. 1 mm are fixed to the image drum 11 in the rotation direction of the image drum 11. The inspection of the surface of the image drum 11 by a surface roughness tester revealed that the adhering material forms a projection that has a height of approx. 0.05 mm.

he SEM observation of the surface of the image drum 11 revealed that the toner is fused thereto. The SEM observation made after careful removal of the fused toner revealed that the titanium oxide alone is fixed to the surface of the image drum 11. That is, the IR chart of the material under the fused toner is very similar to the IR chart of the titanium oxide alone and, therefore, it is evident that the titanium oxide alone was adhered or fixed to the surface of the image drum 11 and, then, the toner was fused on it.

rom the above observation, it is ascertained that even if any materials other than silica are used, the developing blade and the image drum fillings occur, and the fillings are caused by the same mechanism as that in case of the additive of silica.

COMPARABLE EXAMPLE 3

A toner according to this comparable example is manufactured in the same way as that of the comparable example 1 except that 0.5 part by weight of R972 and 0.5 part by weight of RX50 were used.

hen, 300 g of the toner was screened by a screen having a mesh of 45 μm. After residue on the screen was cleaned by ethanol and the toner particles were removed, a large amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 20.5 mg and the extrication amount was $6.8\times10^{-5}$.

The printing endurance test that A-4 size sheets having full-image (printing duty is 100%) were continuously printed using this toner and the image forming apparatus in FIG. 1, was performed.

The test showed that after 500 of sheets 22 were continuously printed, white banding appeared in the direction of printing, and fog also appeared proportionally. Since the white banding was increased as the number of printed copies was increased, the endurance test was stopped when 2,000 copies were finished.

The careful visual inspection revealed a great number of printing jumps that have a width of approx. 0.1 mm and a length of approx. 1 mm. Also, it is ascertained that both developing blade and image drum fillings appeared.

COMPARABLE EXAMPLE 4

A toner according to this comparable example is manufactured in the same way as that of the comparable example 1 except that 0.4 part by weight of R972 and 0.4 part by weight of RX50 were used.

Then, 300 g of the toner was screened by a screen having a mesh of 45 μm. After residue on the screen was cleaned by ethanol and the toner particles were removed, a large amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 17.0 mg and the extrication amount was $5.7\times10^{-5}$.

The printing endurance test that A-4 size sheets having full-image (printing duty is 100%) were continuously printed using this toner and the image forming apparatus in FIG. 1, was performed.

The test showed that after 500 of sheets 22 were continuously printed, white banding appeared in the direction of printing, and fog also appeared proportionally. Since the white banding was increased as the number of printed copies was increased, the endurance test was stopped when 2,000 copies were finished.

The careful visual inspection revealed a great number of printing jumps that have a width of approx. 0.1 mm and a length of approx. 1 mm. Also, it is ascertained that both developing blade and image drum fillings appeared.

COMPARABLE EXAMPLE 5

A toner according to this comparable example is manufactured in the same way as that of the comparable example 1 except that 0.1 part by weight of RX50 was used for the additive agent.

Then, 300 g of the toner was screened by a screen having a mesh of 45 μm. After residue on the screen was cleaned by ethanol and the toner particles were removed, a small amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 2.0 mg and the extrication amount was $6.7\times10^{-6}$.

The printing endurance test that A-4 size sheets having full-image (printing duty is 100%) were continuously printed using this toner and the image forming apparatus in FIG. 1, was performed.

The test showed that even after 50,000 of sheets 22 were continuously printed, there were provided no fog or gaps, such as white banding in a printing direction that is caused by the developing blade filming.

Also, there were provided no image drum filming, wherein the toner and/or additive agent is fixed to the image drum.

However, uneven print density or blurry print was observed from the beginning of the printing. It is ascertained that this occurred because the small amount of the additive agent makes low flowability of the toner so that the toner is not sufficiently supplied to the developing roller 14.

COMPARABLE EXAMPLE 6

One part by weight of R972 and one part by weight of RX50 were added to the developer primary particles produced in the example 9.

Then, the mixture was agitated at 3,000 r/min for 120 seconds by Henschel mixer to provide the toner prepared according to this comparable example.

Then, 300 g of the toner was screened by a screen having a mesh of 45 μm. After residue on the screen was cleaned by ethanol and the toner particles were removed, a large amount of white agglomerate was observed by visual observation. As a result of the IR analysis, the agglomerate was identified as the silica which was added as the additive agent. Also, as a result of the SEM observation, the silica alone formed the agglomerate, forming the floating additive agent. The amount of the floating additive agent at this time was 40.1 mg and the extrication amount was $1.3\times10^{-4}$.

The printing endurance test that A-4 size sheets having full-image (printing duty is 100%) were continuously printed using this toner and the image forming apparatus in FIG. 1, was performed.

The test showed that after 500 of sheets 22 were continuously printed, white banding appeared in the direction of printing, and fog also appeared proportionally. Since the white banding was increased as the number of printed copies was increased, the endurance test was stopped when 2,000 copies were finished.

The careful visual inspection revealed a great number of printing jumps that have a width of approx. 0.1 mm and a length of approx. 1 mm. Also, it is ascertained that both developing blade and image drum fillings appeared.

The present invention is not limited to the above embodiments. Various variations or modifications without departing from the scope of the invention may be made, however, it is interpreted that this invention covers those variations and modifications.

What is claimed is:

1. A method of producing a developer comprising the steps of:

kneading at least a resin and a colorant;

reducing said kneaded resin and colorant to coarse powders;

adding an additive agent to said coarse powders;

reducing said coarse powders with said additive agent to fine powders; and classifying said fine powders to provide said developer.

2. The method according to claim 1, wherein said additive agent is selected from the group consisting of a silica, titanium, a titanium oxide, a clay, an alumina, a calcium carbonate, a methacrylic resin abradant, a melamine resin, and a silicon abradant.

3. A cartridge comprising said developer according to claim 1.

4. An image forming apparatus, comprising:

an image holding device;

a charging device for charging said image holding device;

an exposing device for forming an electrostatic latent image on said charged image holding device;

a developing device for making said electrostatic latent image visible; and said cartridge according to claim 3.

5. A cartridge comprising said developer according to claim 2.

6. An image forming apparatus, comprising:

an image holding device;

a charging device for charging said image holding device;

an exposing device for forming an electrostatic latent image on said charged image holding device;

a developing device for making said electrostatic latent image visible; and said cartridge according to claim 5.

7. The method according to claim 1, further comprising a step of mixing the resin and the colorant to form a mixture before the step of kneading the resin and the colorant.

8. The method according to claim 7, further comprising a step of melting the mixture at a temperature above a melting temperature of the resin before the step of reducing the resin and the colorant.

9. The method according to claim 1, wherein said coarse powders have a first diameter, and said fine powders have a second diameter smaller than one tenth of the first diameter.

* * * * *